US006219430B1

(12) United States Patent
Chien

(10) Patent No.: US 6,219,430 B1
(45) Date of Patent: Apr. 17, 2001

(54) ELECTRONIC APPLIANCE WITH LOUDSPEAKER UNIT

(75) Inventor: Chung-Chi Chien, Taipei (TW)

(73) Assignee: Compal Electronics, Taipei (TW)

( * ) Notice: Subject to any disclaimer, the term of this patent is extended or adjusted under 35 U.S.C. 154(b) by 0 days.

(21) Appl. No.: 09/493,820

(22) Filed: Jan. 28, 2000

(51) Int. Cl.[7] ..... H04R 25/00

(52) U.S. Cl. ..... 381/388; 381/345; 381/386; 381/333

(58) Field of Search ..... 381/87, 306, 333, 381/345, 386, 388, 394, 395; 181/198, 199, 141; 361/680, 681, 682, 683

(56) References Cited

U.S. PATENT DOCUMENTS 4,926,487 * 5/1990 Yoshida et al. ..... 381/333
5,400,408 * 3/1995 Lunggren et al. ..... 381/333

* cited by examiner

*Primary Examiner*—Huyen Le

(74) *Attorney, Agent, or Firm*—Pillsbury Winthrop LLP

(57) ABSTRACT

A lower housing part of an electronic appliance has a side wall extending upwardly from a base wall and formed with a connector mounting opening having a first vertical edge adjacent to a perforated sound port and an opposite second vertical edge. A barrier wall extends upwardly from the base wall, and has a first barrier portion that extends from the second vertical edge of the connector mounting opening, and a second barrier portion parallel to the side wall and registered with the connector mounting opening. The base wall, side wall and barrier wall cooperatively form a connector receiving space thereamong. A loudspeaker unit includes a loudspeaker mechanism mounted in a loudspeaker enclosure that is disposed in the lower housing part adjacent to the side wall such that the loudspeaker mechanism is registered with the sound port. An elongated resonance duct extends from the loudspeaker enclosure toward the first barrier portion and into the connector receiving space, and is disposed immediately above the base wall. The resonance duct is communicated acoustically with the loudspeaker enclosure, and is shorter than the loudspeaker enclosure. A connector unit is disposed in the connector receiving space on top of the resonance duct and between the loudspeaker enclosure and the first barrier portion.

7 Claims, 4 Drawing Sheets

ELECTRONIC APPLIANCE WITH LOUDSPEAKER UNIT

BACKGROUND OF THE INVENTION

1. Field of the Invention

The invention relates to a loudspeaker unit of an electronic appliance, such as a computer, more particularly to a computer having a loudspeaker unit with enhanced low frequency characteristics.

2. Description of the Related Art

Referring to FIGS. 1 and 2, a conventional portable computer is shown to comprise a computer housing 2 having a lower housing part 20 with a side wall 200 that is formed with a perforated sound port 201. A loudspeaker unit 1 includes a loudspeaker enclosure 10 having a loudspeaker mechanism 11 mounted therein. The loudspeaker enclosure 10 is mounted in the computer housing 2 between an upper housing part 21 and the lower housing part 20 adjacent to the side wall 200 with the use of a screw fastener 210 such that the loudspeaker mechanism 11 is registered with the sound port 201.

The quality of the sound output generated by the loudspeaker unit 1 is affected by the size of the loudspeaker enclosure 10. In view of the current trend to make the size of the computer housing 2 as small as possible to enhance portability, the size of the loudspeaker enclosure 10 is accordingly reduced, thereby resulting in an adverse effect on the output sound quality. There is thus a need to improve the quality of the sound output of a loudspeaker unit of a computer without necessitating an increase in the size of the computer housing.

SUMMARY OF THE INVENTION

Therefore, the object of the present invention is to provide an electronic appliance, such as a computer, having a loudspeaker unit with enhanced low frequency characteristics without requiring an increase in the size of the housing of the electronic appliance.

According to the present invention, an electronic appliance comprises a housing, a loudspeaker unit and a connector unit.

The housing includes a lower housing part having a base wall and a side wall that extends upwardly from the base wall. The side wall is formed with a perforated sound port and a connector mounting opening that extends upwardly from the base wall and that has a first vertical edge adjacent to the perforated sound port and a second vertical edge opposite to the first vertical edge in a longitudinal direction of the side wall. The lower housing part further has a barrier wall that extends upwardly from the base wall. The barrier wall has a first barrier portion that extends from the second vertical edge of the connector mounting opening in a transverse direction relative to the longitudinal direction, and a second barrier portion that extends from the first barrier portion in the longitudinal direction. The second barrier portion is disposed parallel to the side wall and is registered with the connector mounting opening in the transverse direction. The barrier wall is formed with a terminal hole. The base wall, the side wall and the barrier wall cooperatively form a connector receiving space thereamong.

The loudspeaker unit includes a loudspeaker enclosure and a loudspeaker mechanism mounted in the loudspeaker enclosure. The loudspeaker enclosure is mounted in the lower housing part adjacent to the side wall such that the loudspeaker mechanism is registered with the sound port.

The loudspeaker unit further has an elongated resonance duct that extends from one side of the loudspeaker enclosure in the longitudinal direction toward the first barrier portion and into the connector receiving space and that is disposed immediately above the base wall. The resonance duct is communicated acoustically with the loudspeaker enclosure, and has a vertical height that is shorter than that of the loudspeaker enclosure. The resonance duct is formed with a low frequency sound hole.

The connector unit is disposed in the connector receiving space on top of the resonance duct and between the loudspeaker enclosure and the first barrier portion. The connector unit has a terminal set that extends through the terminal hole in the barrier wall.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
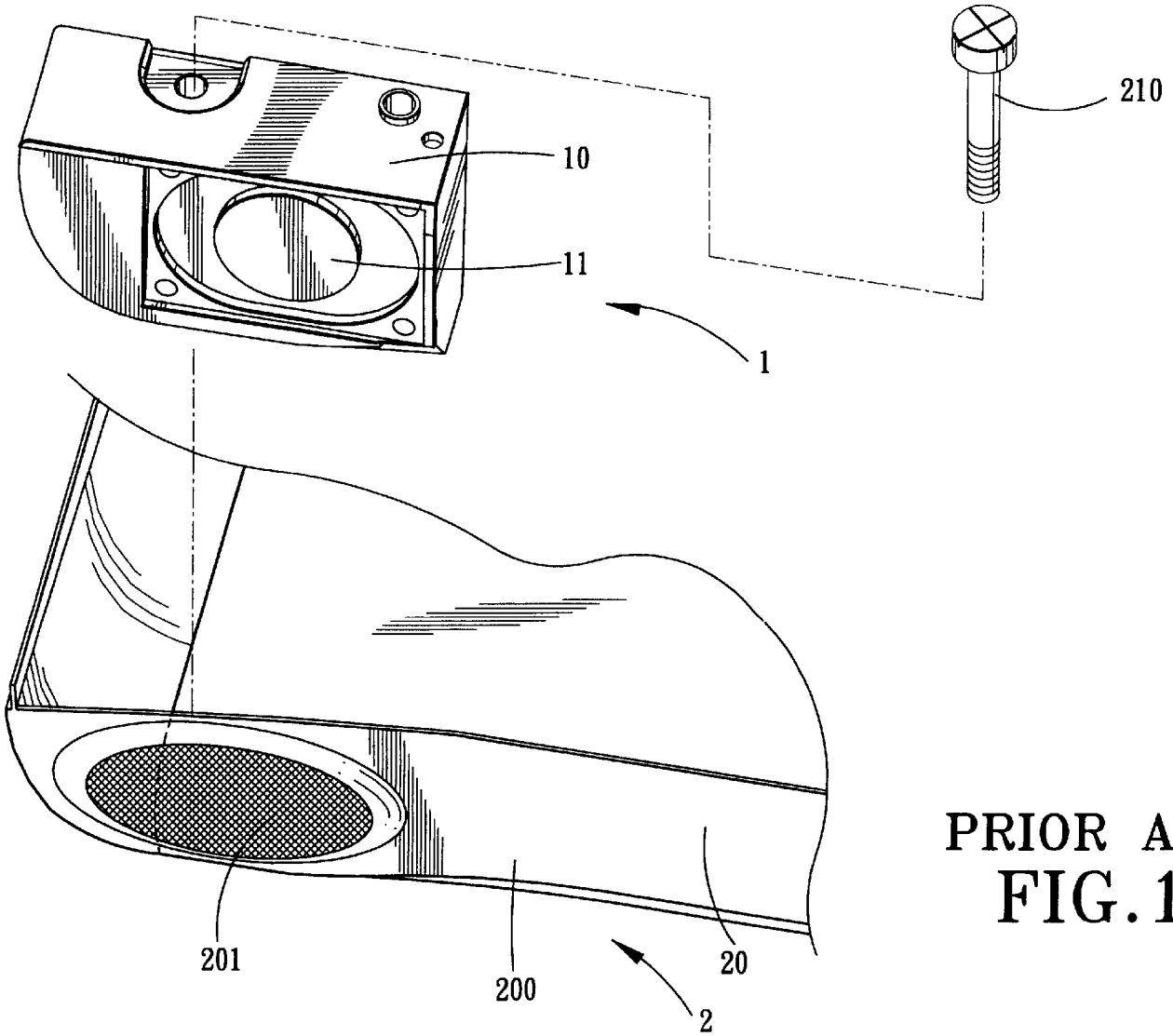
PRIOR ART FIG. 1
FIG. 1 is a fragmentary exploded perspective view showing a conventional computer with a loudspeaker unit.
Figure 2:
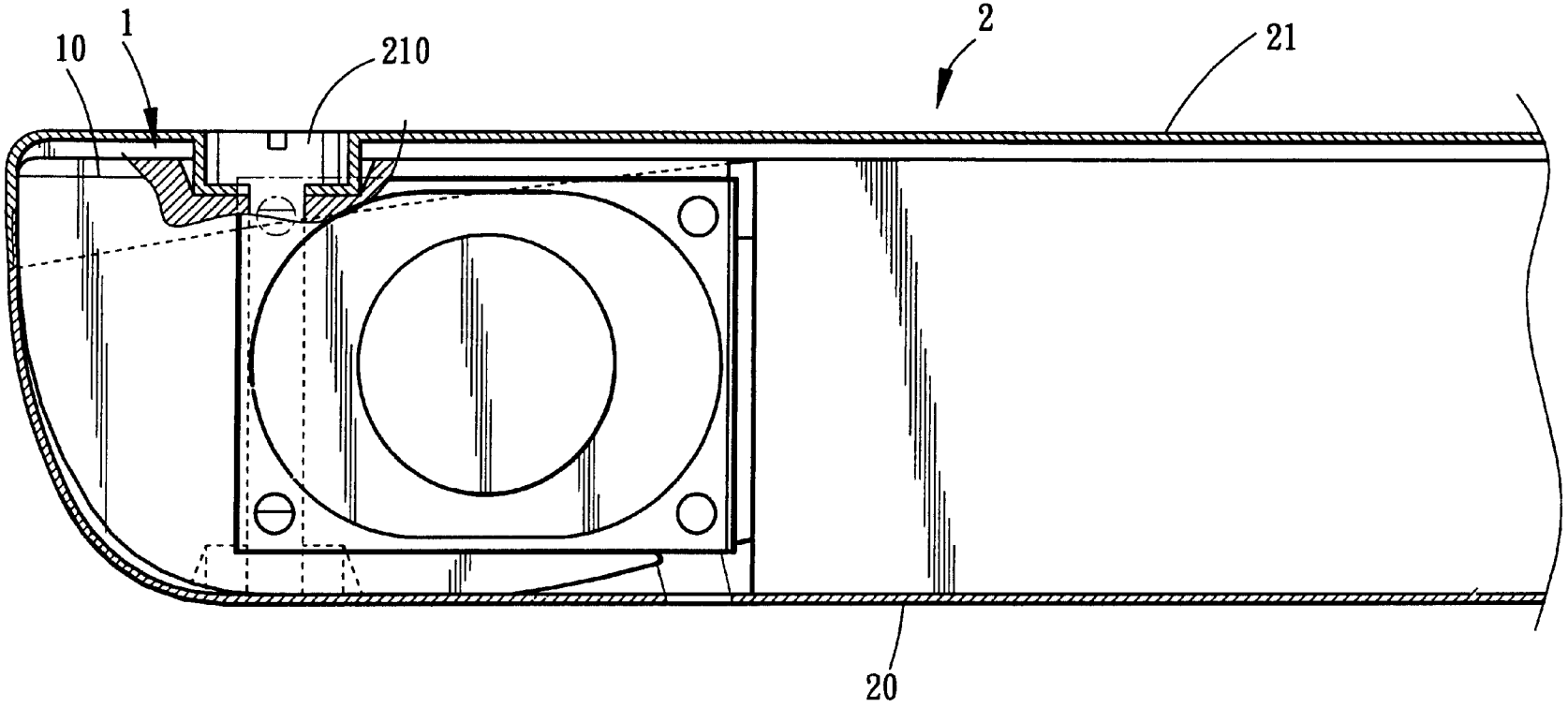
FIG.2 PRIOR ART
FIG. 2 is a fragmentary sectional view of the conventional computer of FIG. 1.
Figure 3:
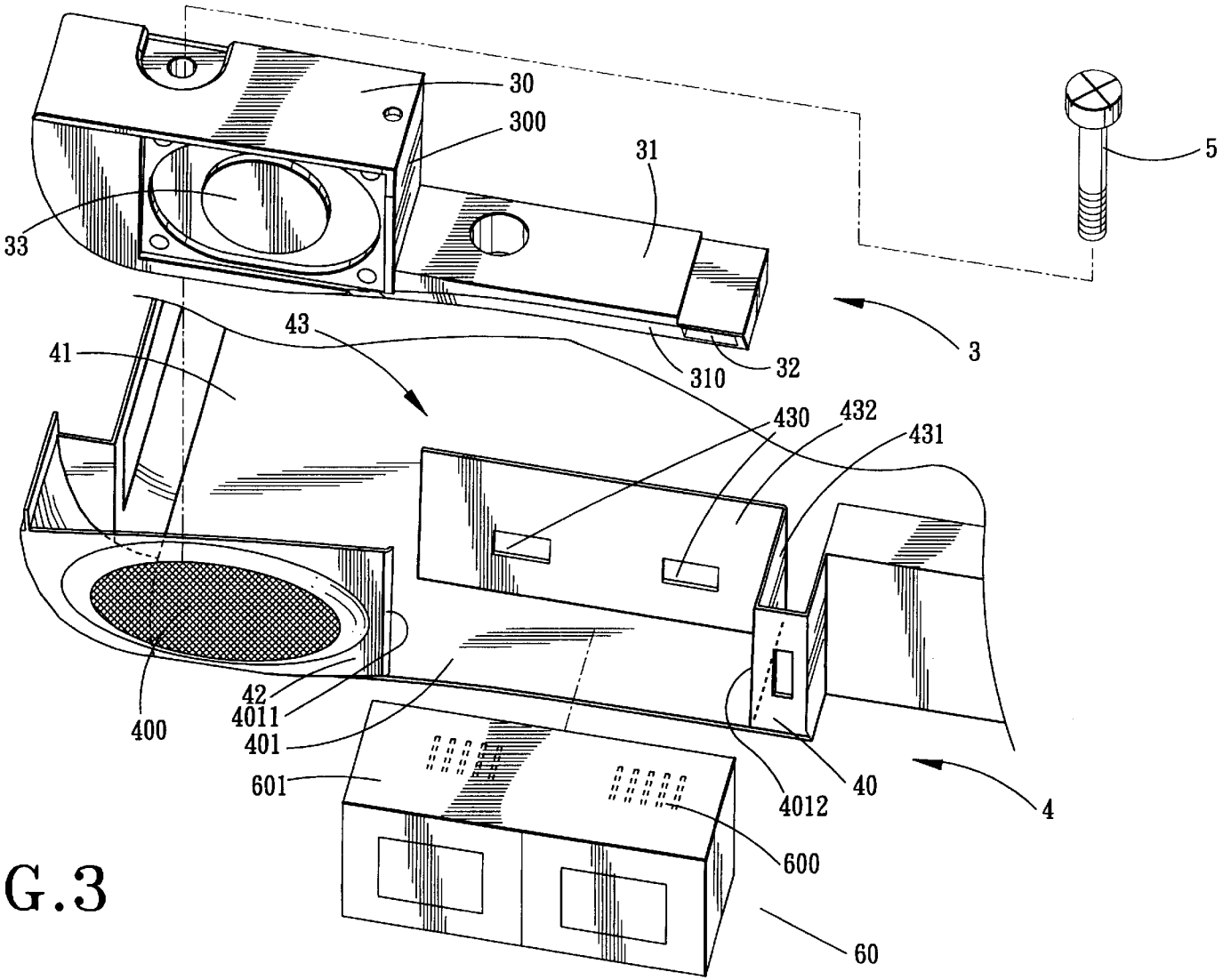
FIG. 3 is a fragmentary exploded perspective view showing the preferred embodiment of an electronic appliance with a loudspeaker unit according to this invention.
Figure 4:
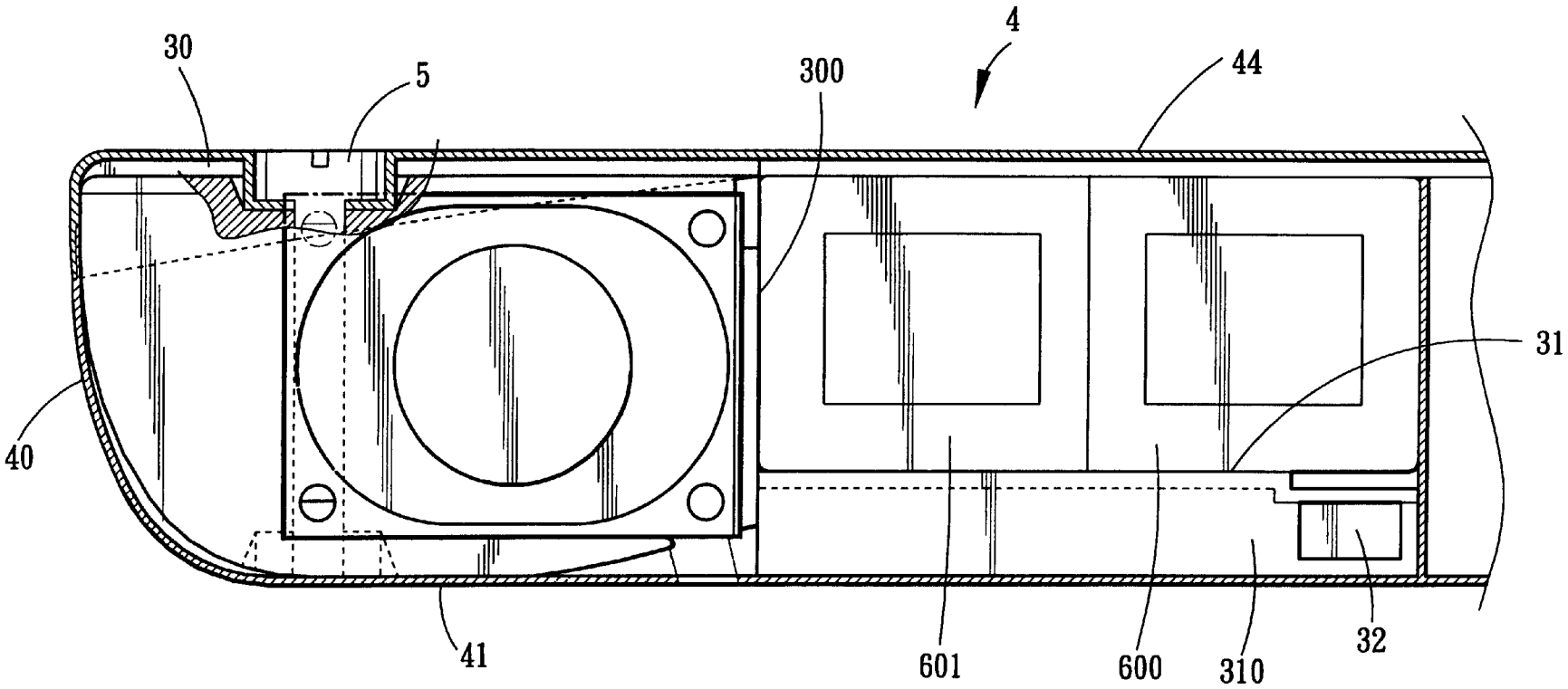
FIG. 4 is a fragmentary sectional view of the preferred embodiment.

Referring to FIGS. 3 and 4, the preferred embodiment of an electronic appliance according to the present invention is shown to be embodied in a portable computer that includes a computer housing 4, a loudspeaker unit 3, and a connector unit 60.

The computer housing 4 includes a lower housing part 40 having a base wall 41 and a side wall 42 that extends upwardly from the base wall 41. The side wall 42 is formed with a perforated sound port 400 and a connector mounting opening 401 that extends upwardly from the base wall 41 and that has a first vertical edge 4011 adjacent to the sound port 400 and a second vertical edge 4012 opposite to the first vertical edge 4011 in a longitudinal direction of the side wall 42. The lower housing part 40 further has a barrier wall 43 that extends upwardly from the base wall 41. The barrier wall 43 has a first barrier portion 431 that extends from the second vertical edge 4012 of the connector mounting opening 401 in a transverse direction relative to the longitudinal direction, and a second barrier portion 432 that extends from the first barrier portion 431 in the longitudinal direction. The second barrier portion 432 is disposed parallel to the side wall 42, and is registered with the connector mounting opening 401 in the transverse direction. The barrier wall 43 is formed with at least one terminal hole 430. In this embodiment, the second barrier portion 432 is formed with a pair of terminal holes 430 that are spaced apart in the longitudinal direction. The base wall 41, the side wall 42 and the barrier wall 43 cooperate to form a connector receiving space thereamong.

The loudspeaker unit 3 includes a loudspeaker enclosure 30 and a loudspeaker mechanism 33 mounted in the loudspeaker enclosure 30. The loudspeaker enclosure 30 is mounted in the computer housing 4 between an upper housing part 44 and the lower housing part 40 adjacent to the side wall 42 with the use of a screw fastener 5 such that the loudspeaker mechanism 33 is registered with the sound port 400. The loudspeaker unit 3 further has an elongated resonance duct 31 that extends from one side 300 of the loudspeaker enclosure 30 in the longitudinal direction toward the first barrier portion 431 and into the connector receiving space and that is disposed immediately above the base wall 41. The resonance duct 31 is communicated acoustically with the loudspeaker enclosure 30, and has a vertical height that is shorter than that of the loudspeaker enclosure 30. The resonance duct 31 is formed with a low frequency sound hole 32 in one end thereof distal to the loudspeaker enclosure 30. In this embodiment, the resonance duct 31 has a front wall 310 adjacent to the side wall 42 and formed with the sound hole 32.

The connector unit 60 of this embodiment includes an RJ45 electrical connector 600 and an RJ11 electrical connector 601, and is disposed in the connector receiving space on top of the resonance duct 31 and between the side 300 of the loudspeaker enclosure 30 and the first barrier portion 431. The terminal set (shown in hidden lines) of each of the electrical connectors 600, 601 extends through a corresponding terminal hole 430 in the barrier wall 43. The connector unit 60 and the loudspeaker unit 3 are retained in the lower housing part 40 by the upper housing part 44. Due to the novel configuration of the loudspeaker unit 3, which includes a resonance duct 31 that permits disposing of the connector unit 60 thereon, the quality of sound output can be enhanced without necessitating an increase in the size of the computer housing 4. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electronic appliance comprising:

a housing including a lower housing part having a base wall and a side wall that extends upwardly from said base wall, said side wall being formed with a perforated sound port and a connector mounting opening that extends upwardly from said base wall and that has a first vertical edge adjacent to said perforated sound port and a second vertical edge opposite to said first vertical edge in a longitudinal direction of said side wall, said lower housing part further having a barrier wall that extends upwardly from said base wall, said barrier wall having a first barrier portion that extends from said second vertical edge of said connector mounting opening in a transverse direction relative to the longitudinal direction, and a second barrier portion that extends from said first barrier portion in the longitudinal direction, said second barrier portion being disposed parallel to said side wall and being registered with said connector mounting opening in the transverse direction, said barrier wall being formed with a terminal hole, said base wall, said side wall and said barrier wall cooperatively forming a connector receiving space thereamong;

a loudspeaker unit including a loudspeaker enclosure and a loudspeaker mechanism mounted in said loudspeaker enclosure, said loudspeaker enclosure being mounted in said lower housing part adjacent to said side wall such that said loudspeaker mechanism is registered with said sound port, said loudspeaker unit further having an elongated resonance duct that extends from one side of said loudspeaker enclosure in the longitudinal direction toward said first barrier portion and into said connector receiving space and that is disposed immediately above said base wall, said resonance duct being communicated acoustically with said loudspeaker enclosure and having a vertical height that is shorter than that of said loudspeaker enclosure, said resonance duct being formed with a low frequency sound hole; and a connector unit disposed in said connector receiving space on top of said resonance duct and between said one side of said loudspeaker enclosure and said first barrier portion, said connector unit having a terminal set that extends through said terminal hole in said barrier wall.

2. The electronic appliance as claimed in claim 1, wherein said terminal hole is formed in said second barrier portion.

3. The electronic appliance as claimed in claim 1, wherein said sound hole is formed in one end of said resonance duct that is distal to said loudspeaker enclosure.

4. The electronic appliance as claimed in claim 3, wherein said resonance duct has a front wall adjacent to said side wall and formed with said sound hole.

5. The electronic appliance as claimed in claim 1, wherein said housing further includes an upper housing part mounted on said lower housing part and retaining said loudspeaker unit and said connector unit in said lower housing part.

6. The electronic appliance as claimed in claim 1, wherein said housing is a portable computer housing.

7. The electronic appliance as claimed in claim 1, wherein said connector unit includes at least one of an RJ11 electrical connector and an RJ45 electrical connector.

* * * * *